US012656029B2

(12) United States Patent
Snell et al.

(10) Patent No.: US 12,656,029 B2
(45) Date of Patent: Jun. 16, 2026

(54) SYSTEM AND METHOD FOR ADJUSTING POSITION OF A COMPRESSOR

(71) Applicant: Tyco Fire & Security GmbH, Neuhausen am Rheinfall (CH)

(72) Inventors: Paul William Snell, York, PA (US); John Trevino, Jr., York, PA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/866,033

(22) PCT Filed: May 16, 2023

(86) PCT No.: PCT/US2023/022352
§ 371 (c)(1),
(2) Date: Nov. 14, 2024

(87) PCT Pub. No.: WO2023/224972
PCT Pub. Date: Nov. 23, 2023

(65) Prior Publication Data

US 2025/0314405 A1 Oct. 9, 2025

Related U.S. Application Data

(60) Provisional application No. 63/387,177, filed on Dec. 13, 2022, provisional application No. 63/342,410, filed on May 16, 2022.

(51) Int. Cl.
*F25B 31/02* (2006.01)
*F25B 49/02* (2006.01)

(52) U.S. Cl.
CPC ..... *F25B 31/02* (2013.01); *F25B 49/022* (2013.01); *F25B 49/025* (2013.01)

(58) Field of Classification Search
CPC ..... F25B 31/02; F25B 49/022; F25B 49/025
See application file for complete search history.

(56) References Cited

U.S. PATENT DOCUMENTS 4,523,896 A * 6/1985 Lhenry ..... F04D 29/058 417/244
5,263,816 A 11/1993 Weimer et al.
(Continued)

FOREIGN PATENT DOCUMENTS

JP 2009281213 A 12/2009
JP 2013127207 A 6/2013
JP 2014231826 A 12/2014

OTHER PUBLICATIONS

PCT International Search Report and Written Opinion for PCT Application No. PCT/US2023/022352, mailed Aug. 31, 2023, 11 pgs.

*Primary Examiner* — Jesse S Bogue
(74) *Attorney, Agent, or Firm* — Fletcher Yoder, PC

(57) ABSTRACT

A heating, ventilation, air conditioning, and refrigeration (HVAC&R) system includes a compressor having a housing, a shaft disposed within and extending through the housing, and an impeller coupled to the shaft, where the shaft is configured to rotate relative to the housing and about an axis to rotate the impeller. The HVAC&R system also includes a controller configured to receive data indicative of a distance from a shroud of the impeller to the housing and to adjust a position of the shaft along the axis based on a comparison of the distance from the shroud of the impeller to the housing with a predetermined value.

20 Claims, 9 Drawing Sheets

(56) References Cited

U.S. PATENT DOCUMENTS

| | | | | |
|---|---|---|---|---|
| 5,924,847 | A | 7/1999 | Scaringe et al. | |
| 6,997,686 | B2 * | 2/2006 | Agrawal | F04D 25/0606 417/370 |
| 8,384,232 | B2 * | 2/2013 | Myers | H02K 7/09 290/52 |
| 10,724,546 | B2 * | 7/2020 | Morgan | F01D 11/24 |
| 10,968,919 | B2 * | 4/2021 | Sishtla | F04D 29/051 |
| 11,885,347 | B2 * | 1/2024 | Kawae | F16C 32/0603 |
| 12,339,047 | B2 * | 6/2025 | Sheaffer | F04D 27/0253 |
| 2012/0013125 | A1 | 1/2012 | Myers et al. | |
| 2012/0063918 | A1 | 3/2012 | De Larminat et al. | |
| 2013/0039740 | A1 | 2/2013 | Hawkins | |
| 2014/0216087 | A1 * | 8/2014 | Sishtla | F04D 29/058 417/423.12 |
| 2015/0361993 | A1 * | 12/2015 | An | F01D 5/027 416/61 |
| 2020/0259394 | A1 * | 8/2020 | Snell | H02K 5/124 |
| 2020/0378260 | A1 * | 12/2020 | Wakashima | F02B 39/16 |

* cited by examiner

SYSTEM AND METHOD FOR ADJUSTING POSITION OF A COMPRESSOR

CROSS REFERENCE TO RELATED APPLICATIONS

This application is a U.S. National Stage Application of PCT International Application No. PCT/US2023/022352, entitled "SYSTEM AND METHOD FOR ADJUSTING POSITION OF A COMPRESSOR," filed May 16, 2023, which claims priority to and the benefit of U.S. Provisional Application No. 63/342,410, entitled "SYSTEM AND METHOD FOR ADJUSTING POSITION OF A COMPRESSOR," filed May 16, 2022, and U.S. Provisional Application No. 63/387,177, entitled "SYSTEM AND METHOD FOR ADJUSTING POSITION OF A COMPRESSOR," filed Dec. 13, 2022, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Chiller systems, or vapor compression systems, utilize a working fluid (e.g., a refrigerant) that changes phases between vapor, liquid, and combinations thereof in response to exposure to different temperatures and pressures within components of the chiller system. The chiller system may place the working fluid in a heat exchange relationship with a cooling fluid (e.g., water) and may deliver the cooling fluid to conditioning equipment and/or a conditioned environment serviced by the chiller system. In such applications, the cooling fluid may be directed through downstream equipment, such as air handlers, to condition other fluids, such as air in a building. The chiller system may include a compressor configured to pressurize the working fluid and circulate the working fluid through a working fluid circuit. Unfortunately, the compressor may be susceptible to inefficient or undesirable operations.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, air conditioning, and refrigeration (HVAC&R) system includes a compressor having a housing, a shaft disposed within and extending through the housing, and an impeller coupled to the shaft, where the shaft is configured to rotate relative to the housing and about an axis to rotate the impeller. The HVAC&R system also includes a controller configured to receive data indicative of a distance from a shroud of the impeller to the housing and to adjust a position of the shaft along the axis based on a comparison of the distance from the shroud of the impeller to the housing with a predetermined value.

In another embodiment, a heating, ventilation, air conditioning, and refrigeration (HVAC&R) system includes a controller configured to receive, from a sensor disposed within a compressor, data indicative of a distance from a shroud of an impeller to a housing of the compressor, compare the distance to a predetermined value, and adjust a position of a shaft coupled to the impeller along a rotational axis of the shaft based on comparison of the distance from the shroud of the impeller to the housing with the predetermined value to adjust a position of the impeller relative to the housing.

In a further embodiment, a heating, ventilation, air conditioning, and refrigeration (HVAC&R) system includes a compressor having a housing, a shaft disposed within and extending through the housing, a thrust bearing disposed within the housing and coupled to the shaft, and an impeller disposed within the housing and coupled to the shaft, where the impeller includes a plurality of blades and a shroud fixed to the plurality of blades. The HVAC&R system also includes a controller configured to control operation of the thrust bearing based on data indicative of a detected distance from the housing to the shroud of the impeller.

DRAWINGS

Various aspects of this disclosure may be better understood upon reading the following detailed description and upon reference to the drawings in which.

DETAILED DESCRIPTION

Figure 1:
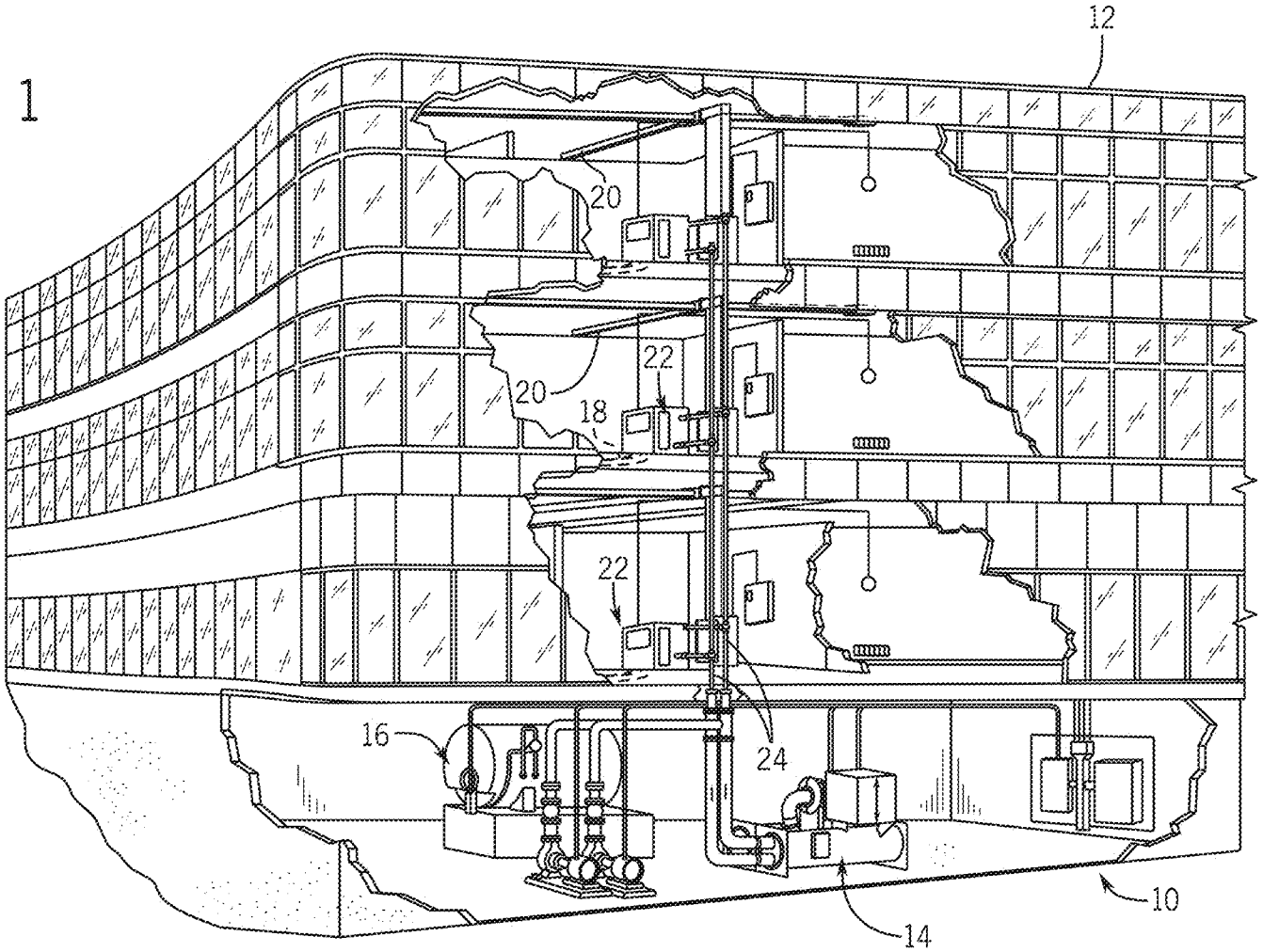
FIG. 1 is a perspective view of a building that may utilize an embodiment of a heating, ventilation, air conditioning, and refrigeration (HVAC&R) system in a commercial setting, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

Embodiments of the present disclosure relate to a heating, ventilation, air conditioning, and refrigeration (HVAC&R) system including a vapor compression system (e.g., vapor compression circuit) having a compressor. In operation, the compressor may pressurize a working fluid within the vapor compression system and direct the working fluid to a condenser, which may cool and condense the working fluid. The condensed working fluid may be directed to an expansion device, which may reduce a pressure of the working fluid, further cooling the working fluid. From the expansion device, the cooled working fluid may be directed to an evaporator, where the working fluid may be placed in a heat exchange relationship with a conditioning fluid to cool the conditioning fluid.

In some embodiments, the compressor may include an impeller configured to rotate to pressurize the working fluid and to direct the working fluid to a diffuser passage of the compressor. For example, the impeller may be coupled to a shaft, and the shaft may be configured to rotate relative to a housing of the compressor to drive rotation of the impeller relative to the housing. However, during operation of the compressor, a geometry and/or a position of the impeller (e.g., relative to the housing and/or the diffuser passage) may change and affect performance of the compressor. As an example, the position the impeller may shift such that an exit or outlet of the impeller may be offset (e.g., misaligned) relative to an opening of the diffuser passage. The offset between the outlet of the impeller and the opening of the diffuser passage may reduce an efficiency of the compressor. For example, misalignment between the outlet of the impeller and the opening of the diffuser passage may interrupt, disrupt, or disturb a flow of working fluid through the compressor (e.g., from the impeller to the diffuser passage). Disruption of the flow of working fluid through the compressor may cause a pressure loss or head loss, thereby reducing efficiency of working fluid flow through the compressor. In additional or alternative embodiments, the position of the impeller may shift toward the housing and may increase a likelihood of contact between the impeller (e.g., a shroud of the impeller, a tip of a blade of the impeller) and the housing. Such contact may affect a structural integrity of the impeller and/or the housing and/or may interrupt or disrupt operation of the compressor.

Thus, it is now recognized that maintaining a desirable position of the impeller (e.g., within the housing of the compressor) during operation may improve performance, reduce wear, and/or increase a useful lifespan of the compressor. Accordingly, the present disclosure is directed to a system and method for monitoring the position of the impeller and adjusting a position of the impeller (e.g., relative to the housing) based on the monitored position. For instance, an operating parameter value indicative of the position of the impeller may be received, such as from a sensor of the compressor. In some embodiments, the operating parameter may include a distance between a surface of the impeller and the housing of the compressor. As an example, the surface of the impeller may be a surface of a shroud of the impeller. As another example, the surface of the impeller may be a tip of a blade of the impeller. In response to a determination that the distance between the surface of the impeller and the housing of the compressor is different from a predetermined distance value and/or is outside of a range (e.g., target range, threshold range) of distance values, a position of the shaft to which the impeller is attached may be adjusted to move the impeller relative to the housing. For example, the shaft may be translated (e.g., via control of a thrust bearing coupled to the shaft) to move the impeller relative to the housing and thereby adjust the distance between the surface of the impeller and the housing to be within the range of distance values.

In some instances, the predetermined distance value and/or the range of distance values may be associated with a desirable alignment between the outlet of the impeller and the opening of the diffuser passage and/or a desirable clearance between the impeller and the housing. Therefore, adjusting the position of the shaft and the impeller to be approximately equal to the predetermined distance value and/or to be within the range of distance values may achieve the desirable alignment between the outlet of the impeller and the opening of the diffuser passage and/or provide the desirable clearance between the impeller and the housing. For example, maintaining the position of the shaft and the impeller within the range of distance values may improve efficient operation of the compressor. Indeed, the disclosed techniques enable positional adjustment of the impeller within the housing of the compressor (e.g., alignment of the outlet of the impeller with the opening of the diffuser passage) during operation of the compressor, such as in response to variable operating conditions of the compressor. In this way, operation of the compressor may be improved (e.g., more efficient) across variable operating conditions of the compressor.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 (e.g., a chiller) that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
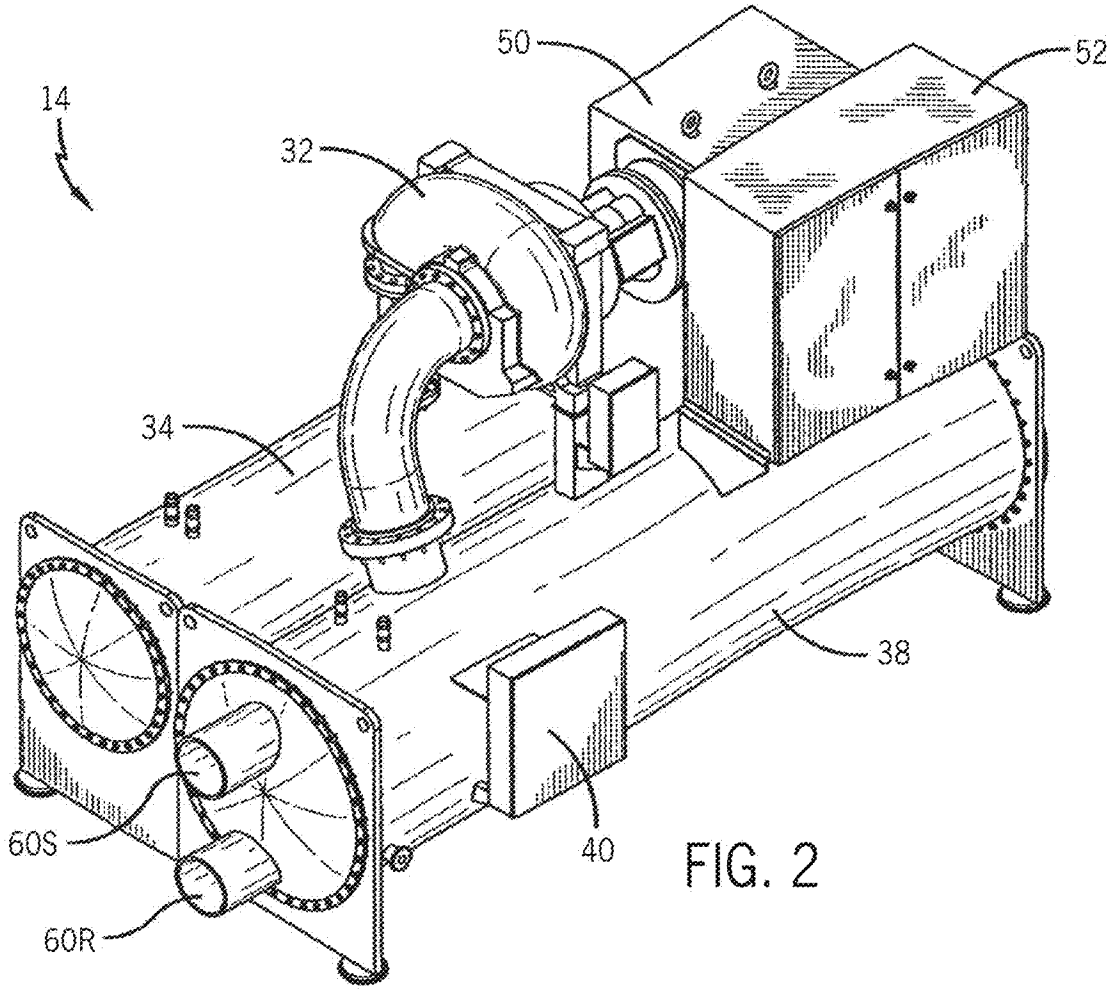
FIG. 2 is a perspective view of an embodiment of a vapor compression system, in accordance with an aspect of the present disclosure.
Figure 3:
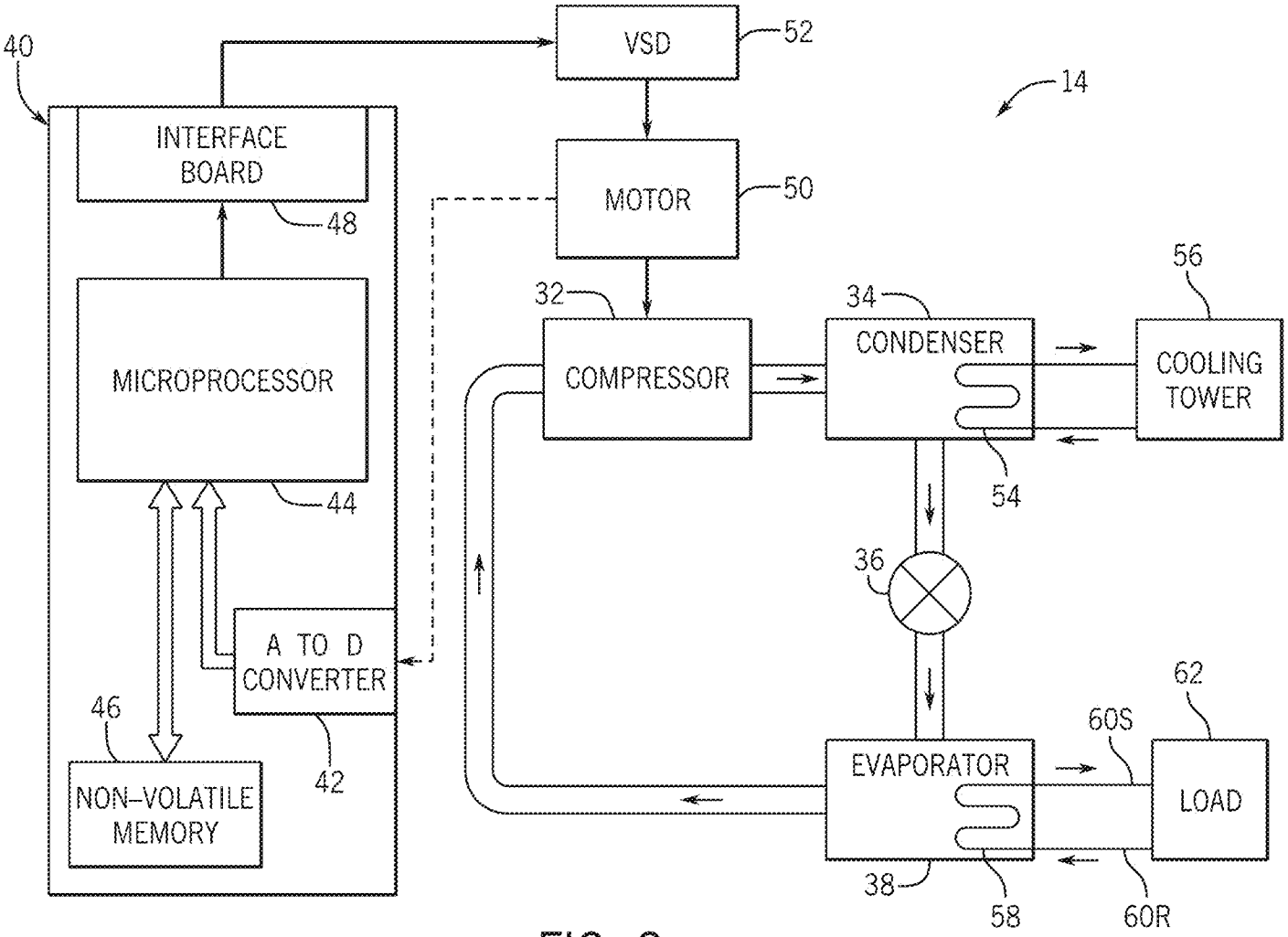
FIG. 3 is a schematic of an embodiment of the vapor compression system of FIG. 2, in accordance with an aspect of the present disclosure.

FIGS. 2 and 3 are embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, R-1233zd, R-1234ze, hydrofluoro olefin (HFO), "natural" refrigerants like ammonia (NH3), R-717, carbon dioxide (CO2), R-744, or hydrocarbon-based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The liquid refrigerant delivered to the evaporator 38 may absorb heat from another cooling fluid, which may or may not be the same cooling fluid used in the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the vapor refrigerant exits the evaporator 38 and returns to the compressor 32 by a suction line to complete the cycle.

Figure 4:
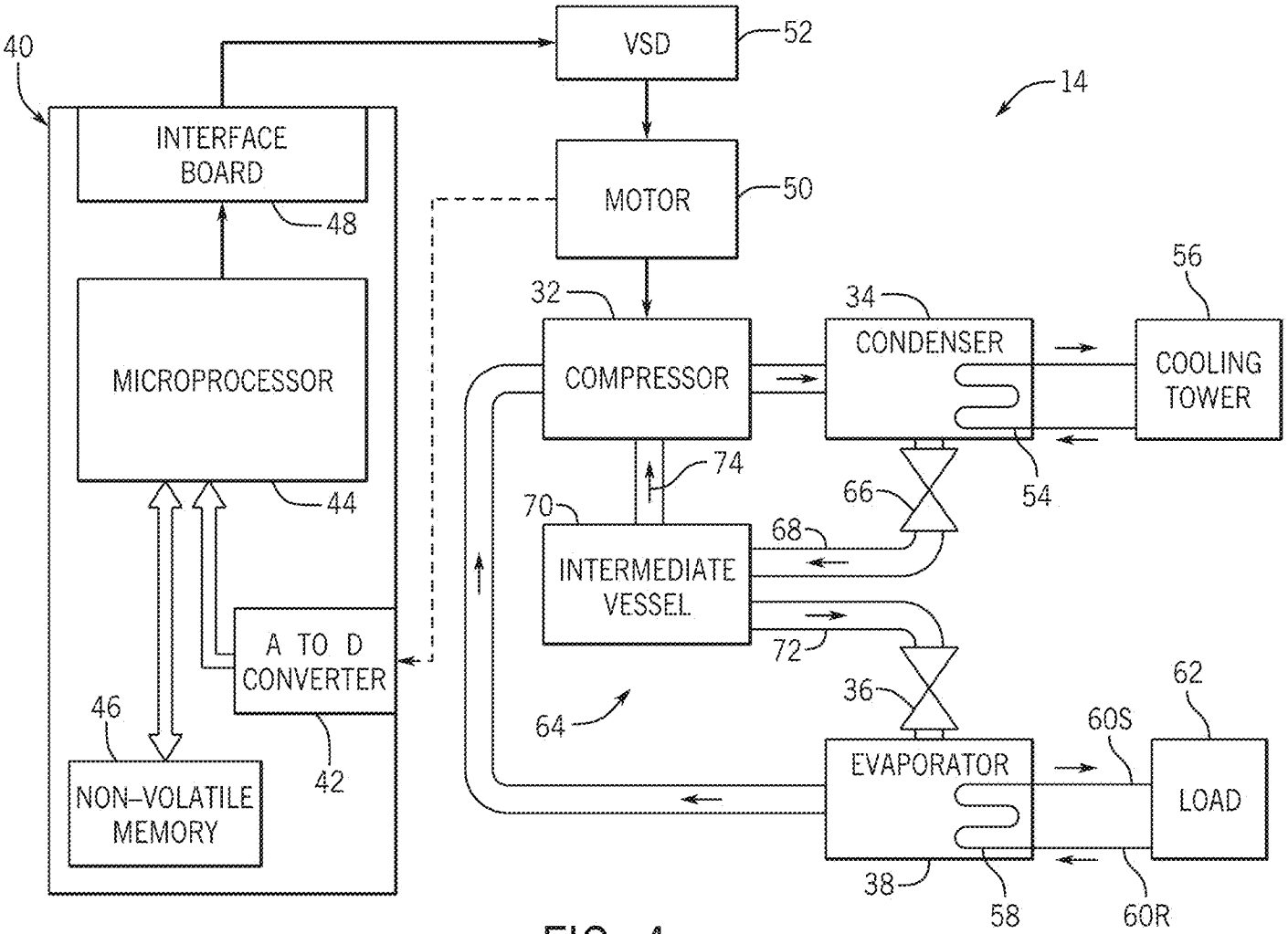
FIG. 4 is a schematic of an embodiment of the vapor compression system of FIG. 2, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler, an economizer, etc.). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid refrigerant received from the condenser 34. During the expansion process, a portion of the liquid may vaporize, and thus, the intermediate vessel 70 may be used to separate the vapor from the liquid received from the first expansion device 66.

Additionally, the intermediate vessel 70 may provide for further expansion of the liquid refrigerant because of a pressure drop experienced by the liquid refrigerant when entering the intermediate vessel 70 (e.g., due to a rapid increase in volume experienced when entering the intermediate vessel 70). The vapor in the intermediate vessel 70 may be drawn by the compressor 32 through a suction line 74 (e.g., an interstage line) of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the liquid refrigerant exiting the condenser 34 because of the expansion in the expansion device 66 and/or the intermediate vessel 70. The liquid from intermediate vessel 70 may then flow in line 72 through a second expansion device 36 to the evaporator 38.

It should be appreciated that any of the features described herein may be incorporated with the vapor compression system 14 or any other suitable HVAC&R systems. For example, the present techniques may be incorporated with any HVAC&R system having an economizer, such as the intermediate vessel 70, and a compressor, such as the compressor 32. The discussion below describes the present techniques incorporated with embodiments of the compressor 32 configured as a single stage compressor. However, it should be noted that the systems and methods described herein may be incorporated with other embodiments of the compressor 32 and HVAC&R system 10.

As mentioned above, the present disclosure is directed to a system and method for adjusting an impeller of a compressor to achieve and/or maintain a desirable position of the impeller within a housing of the compressor. For example, the distance between a surface of the impeller and a housing of the compressor may be detected and/or monitored. Based on a determination that the distance is not equal to a predetermined distance value and/or is outside of a range of distance values associated with the desirable position of the impeller, the position of the impeller may be adjusted. For instance, the impeller may be coupled to a shaft, and a position of the shaft may be adjusted to adjust the distance between the surface of the impeller and the housing to be within the range of distance values. In other words, the position of the shaft may be controlled to maintain the distance between the surface of the impeller and the housing within the range of distance values and/or to be approximately equal to the predetermined distance value. In this way, the present techniques enable adjustment of the position of the impeller, such as to achieve alignment between an outlet of the impeller and an inlet of a diffuser passage of the compressor, thereby enabling more efficient operation of the compressor.

Figure 5:
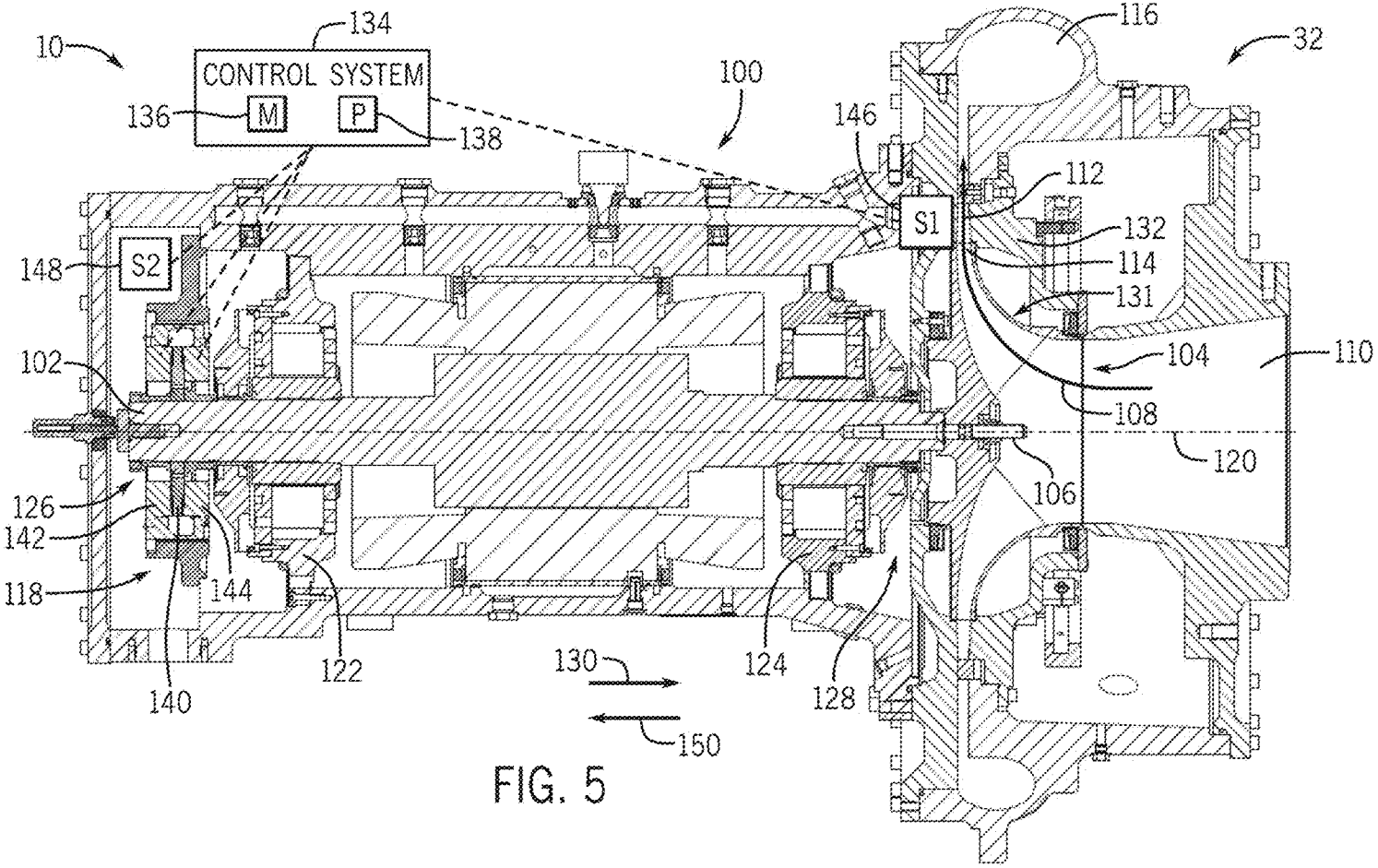
FIG. 5 is a cross-sectional side view of an embodiment of a compressor of an HVAC&R system, in accordance with an aspect of the present disclosure.

With the foregoing in mind, FIG. 5 is a cross-sectional side view of an embodiment of the compressor 32 of the HVAC&R system 10. The compressor 32 may include a housing 100 and a shaft 102 extending through the housing 100. The compressor 32 may also include an impeller 104 coupled to the shaft 102, such as via a fastener 106. During operation of the compressor 32, the shaft 102 may rotate (e.g., via operation of the motor 50) and cause rotation of the impeller 104 within the housing 100. Rotation of the impeller 104 may drive a working fluid (e.g., refrigerant) to flow along a working fluid flow path 108 (e.g., from the evaporator 38, from the intermediate vessel 70) and to draw the working fluid into the housing 100 via a suction inlet 110 and toward the impeller 104. The impeller 104 may impart mechanical energy to the working fluid and discharge the working fluid toward a diffuser passage 112 of the compressor 32 via an impeller exit or outlet 114 of the impeller 104. The working fluid may be directed from the diffuser passage 112 to a volute 116 of the compressor 32 and from the volute 116 to another component of the HVAC&R system 10 (e.g., the condenser 34) for heat exchange with a fluid, such as a cooling fluid.

In the illustrated embodiment, the compressor 32 includes a first bearing 118 (e.g., an axial bearing, a thrust bearing, a magnetic thrust bearing) configured to control and/or adjust a position (e.g., axial position) of the shaft 102 along an axis 120 (e.g., a longitudinal axis, a rotational axis of the shaft 102) extending along a length of the compressor 32. For example, the first bearing 118 may be configured to block or limit movement (e.g., translation) of the shaft 102 along the axis 120 and/or relative to the axis 120. The compressor 32 may also include a second bearing 122 (e.g., a first radial bearing) and a third bearing 124 (e.g., a second radial bearing). The second bearing 122 and the third bearing 124 may block movement (e.g., bending, radial movement, eccentric rotation) of the shaft 102 in a direction crosswise to the axis 120.

In some embodiments, the first bearing 118 may be positioned at or coupled to a first end 126 (e.g., an axial end, a longitudinal end) of the shaft 102, and the impeller 104 may be positioned at or coupled to a second end 128 (e.g., an axial end, a longitudinal end), opposite the first end 126, of the shaft 102. Thus, the first bearing 118 and the impeller 104 may be positioned at opposite ends 126, 128 of the shaft 102. Additionally, in the illustrated embodiment, the second bearing 122 is positioned adjacent to the first bearing 118 at the first end 126 of the shaft 102, and the third bearing 124 is positioned adjacent to the impeller 104 at the second end 128 of the shaft 102. The positioning of the impeller 104 and the third bearing 124 at the second end 128 of the shaft 102 and the first bearing 118 and the second bearing 122 at the first end 126 of the shaft 102 may enable desirable rotation and/or other operation for the shaft 102. For example, the arrangement of the impeller 104, first bearing 118, second bearing 122, and third bearing 124 may enable stable (e.g., concentric) rotation of the shaft 102 and/or provide control of the respective positions of the impeller 104 and the shaft 102 (e.g., relative to the housing 100), such as with respect to a system in which the first bearing 118 is positioned more adjacent to the impeller 104 (e.g., at the second end 128). Further, the described arrangement of the illustrated embodiment may provide a more balanced weight and/or load distribution along the shaft 102 and improved stability during rotation of the shaft 102 and the impeller 104 during operation of the compressor 32.

As mentioned above, during operation of the compressor 32, the impeller 104 may be susceptible to a change in geometry and/or a change in position relative to the housing 100. As an example, rotation of the impeller 104 during operation of the compressor 32 may generate heat along the shaft 102, which may cause thermal growth and/or expansion of the shaft 102 (e.g., along the axis 120) that may drive the impeller 104 to move in a first direction 130 (e.g., a first axial direction) along the axis 120 relative to the housing 100. As another example, rotation of the impeller 104 may cause blades 131 of the impeller 104 to bend, deflect, or flex toward a portion of the housing 100. That is, during greater rotational speeds of the impeller 104 (e.g., an unshrouded or open impeller), the blades 131 may bend, pivot, rotate, or otherwise deflect outward (e.g., relative to the axis 120, along the axis 120). In either example, one or more surfaces (e.g., blade surfaces, shroud-facing surfaces, top surfaces) of the impeller 104 may move or shift at least partially in the first direction 130 relative to the housing 100.

As will be appreciated, it may be desirable to limit, reduce, and/or adjust movement of the impeller 104 along the axis 120, such as in response to movement or shifting of the impeller 104 within the housing 100 that may be induced during operation of the compressor 32. By way of example, movement of the impeller 104 along the axis 120 may cause misalignment of the impeller exit 114 and the diffuser passage 112 (e.g., relative to a flow direction of the working fluid therethrough). Additionally, movement of the impeller 104 along the axis 120 may reduce a distance (e.g., a clearance) between the impeller 104 and a portion of the housing 100. For example, movement of the impeller 104 along the first direction 130 may position the impeller 104 closer to a shroud housing portion 132 (e.g., stationary portion, impeller housing portion, blade housing portion, nozzle plate housing portion) of the housing 100. Such movement may adversely affect performance and/or structural integrity of the compressor 32. For example, movement of the impeller 104 in the first direction 130 may cause contact between the impeller 104 (e.g., a shroud of the impeller 104, blades 131 of the impeller 104) and the shroud housing portion 132, which may cause wear or degradation on the impeller 104 and/or the housing 100. It may also be desirable to limit (e.g., reduce) a magnitude of the distance (e.g., a clearance) between the impeller 104 and shroud housing portion 132 of the housing 100 to enable improved (e.g., more efficient) operation of the compressor 32.

Accordingly, the HVAC&R system 10 may include a control system 134 (e.g., a controller, an automation controller, an electronic controller, a magnetic bearing controller) configured to operate the compressor 32 to mitigate and/or adjust movement of the impeller 104 along the axis 120. For example, the control system 134 may be configured to monitor and/or adjust a position of the impeller 104 within the housing 100 to mitigate misalignment of the impeller exit 114 and the diffuser passage 112. The control system 134 may include a memory 136 and processing circuitry 138 (e.g., a microprocessor). The memory 136 may include volatile memory, such as random-access memory (RAM), and/or non-volatile memory, such as read-only memory (ROM), optical drives, hard disc drives, solid-state drives, or any other tangible, non-transitory computer-readable medium storing instructions that, when executed by the processing circuitry 138, control operation of the compressor 32. The processing circuitry 138 may be configured to execute the instructions stored on the memory 136. As an example, the processing circuitry 138 may include one or more application specific integrated circuits (ASICs), one or more field programmable gate arrays (FPGAs), one or more general purpose processors, or any combination thereof. The processing circuitry 138 may include multiple microprocessors, one or more "general-purpose" microprocessors, one or more special-purpose microprocessors, and/or some combination thereof. For example, the processing circuitry 138 may include one or more reduced instruction set (RISC) processors.

The control system 134 may be configured to enable adjustment of a position (e.g., an axial position) of the impeller 104 along the axis 120 and/or relative to the housing 100. By way of example, the control system 134 may be configured to enable positional adjustment of the shaft 102 along the axis 120 to drive movement (e.g., adjust a position) of the impeller 104 along the axis 120. In some embodiments, the compressor 32 may include a collar 140 (e.g., a thrust collar) fixedly coupled to the shaft 102. Thus, movement of the collar 140 may cause corresponding movement of the shaft 102. The first bearing 118 may control movement (e.g., axial movement) of the collar 140, and therefore of the shaft 102 and the impeller 104, along the axis 120. For instance, the first bearing 118 may be a magnetic bearing assembly that includes a first magnetic bearing component or portion 142 (e.g., a first magnetic winding, a first electromagnet) and a second magnetic bearing component or portion 144 (e.g., a second magnetic winding, a second electromagnet). The collar 140 may be positioned between (e.g., axially between, relative to axis 120) the magnetic bearing components 142, 144, and each of the magnetic bearing components 142, 144 may impart a magnetic force onto the collar 140 to adjust a position of the collar 140 along the axis 120. For example, the magnetic bearing components 142, 144 may have magnetic poles (e.g., a forward pole, a reverse pole) that impart the magnetic force onto the collar 140.

In some instances, during operation of the compressor 32, the magnetic force(s) imparted by the magnetic bearing components 142, 144 may block movement of the collar 140 along the axis 120. For example, the control system 134 may be configured to control the first bearing 118 to block movement of the collar 140 along the axis 120 to maintain alignment (e.g., radial alignment relative to axis 120) of the impeller exit 114 and the diffuser passage 112. However, the collar 140, and therefore the shaft 102, may freely rotate (e.g., via the motor 50) to drive rotation of the impeller 104. In some embodiments, a magnitude of the magnetic force imparted to the collar 140 by one or both of the magnetic bearing components 142, 144 (e.g., a total magnetic force) may be adjustable. As an example, the magnetic force (e.g., a total magnetic force applied to the collar 140) may be increased to compensate for adjustment and/or movement of a portion of the shaft 102 (e.g., at the second end 128) that may otherwise occur as a result of thermal growth during operation of the compressor 32. In other words, thermal growth may cause the shaft 102 to move undesirably in a particular direction (e.g., in the first direction 130), and the magnetic force may be applied to the collar 140 via the magnetic bearing components 142, 144 to move the shaft 102 in a direction opposite the particular direction (e.g., opposite the first direction 130) to reduce or mitigate overall movement of the shaft 102, such as to block movement of the shaft 102 toward the shroud housing portion 132.

The control system 134 may be communicatively coupled to the first bearing 118 and may also be configured to control movement and/or positional adjustment the collar 140, and therefore the shaft 102, along the axis 120 via the magnetic bearing components 142, 144. For example, the control system 134 may be configured to adjust an electrical current provided to the magnetic bearing components 142, 144 to adjust a magnetic force (e.g., an overall magnetic force, an electromagnetic force, a magnetic field) imparted onto the collar 140. A position of the collar 140 between the magnetic bearing components 142, 144 (e.g., an axial position) may be adjusted by changing the magnetic force imparted to the collar 140, such as by pushing and/or pulling the collar 140 along the axis 120 via the magnetic force.

In some embodiments, the compressor 32 may include one or more sensors communicatively coupled to the control system 134 and configured to detect one or more operating parameters of the compressor 32. The control system 134 may adjust operation of the first bearing 118 based on feedback and/or data from the one or more sensors. For example, the compressor 32 may include a first sensor 146 (e.g., a proximity sensor, a position sensor, a capacitive sensor) configured to monitor an operating parameter indicative of an axial position of the impeller 104 (e.g., along the axis 120, relative to the housing 100). The first sensor 146 may transmit sensor data indicative of the operating parameter to the control system 134, and the control system 134 may control the first bearing 118 (e.g., the magnetic bearing components 142, 144) to adjust the position of the collar 140 based on the sensor data received from the first sensor 146. As an example, the control system 134 may control the first bearing 118 to maintain a desirable axial position of the collar 140, and therefore of the impeller 104, along the axis 120. In some embodiments, the control system 134 may control the first bearing 118 to maintain a desirable axial position of the collar 140 that is associated with or corresponds to alignment of the impeller exit 114 and the diffuser passage 112.

The compressor 32 may also include a second sensor 148 configured to monitor a position of the collar 140, such as relative to the magnetic bearing components 142, 144 (e.g., along the axis 120). The second sensor 148 may transmit sensor data indicative the position of the collar 140 to the control system 134, and the control system 134 may control operation of the first bearing 118 to adjust the position of the collar 140 based on the sensor data received from the second sensor 148. For instance, the control system 134 may control the first bearing 118 to maintain the position of the collar 140 within a predetermined range of collar 140 positions. In some embodiments, the predetermined range of collar 140 positions may correspond to alignment of the impeller exit 114 with the diffuser passage 112. By controlling the magnetic bearing components 142, 144 to maintain the collar 140 within the predetermined range of collar positions, contact between the collar 140 and the magnetic bearing components 142, 144 may be avoided. As an example, the control system 134 may control the first bearing 118 to maintain a desirable axial position of the impeller 104 without moving the collar 140 outside of the predetermined range of collar positions. The control system 134 may be configured to control the first bearing 118 to drive the collar 140 and the impeller 104 to move in the first direction 130 along the axis 120 and/or in a second direction 150 (e.g., a second axial direction), opposite the first direction 130, along the axis 120. Indeed, the control system 134 may control the first bearing 118 based on sensor data received (e.g., from the first sensor 146, from the second sensor 158) during operation of the compressor 32. In some embodiments, the control system 134 may control the first bearing 118 based on additional or alternative data and/or feedback (e.g., received from additional sensors), such as data indicative of an operating capacity of the compressor 32, a speed of the compressor 32, a pressure of working fluid circulated by the compressor 32, a flow rate of working fluid circulated by the compressor 32, another suitable operating parameter, or any combination thereof. Thus, the control system 134 may dynamically adjust positions of the collar 140 and the impeller 104 via control of the first bearing 118 in real-time while the compressor 32 is in operation (e.g., the shaft 102 and/or the impeller 104 are rotating) to maintain the impeller 104 in a desirable position. Indeed, it should be appreciated that, in accordance with the present techniques, the control system 134 may be utilized with any of the embodiments and/or features of the compressor 32 described herein to enable desirable positioning of the impeller 104.

Figure 6:
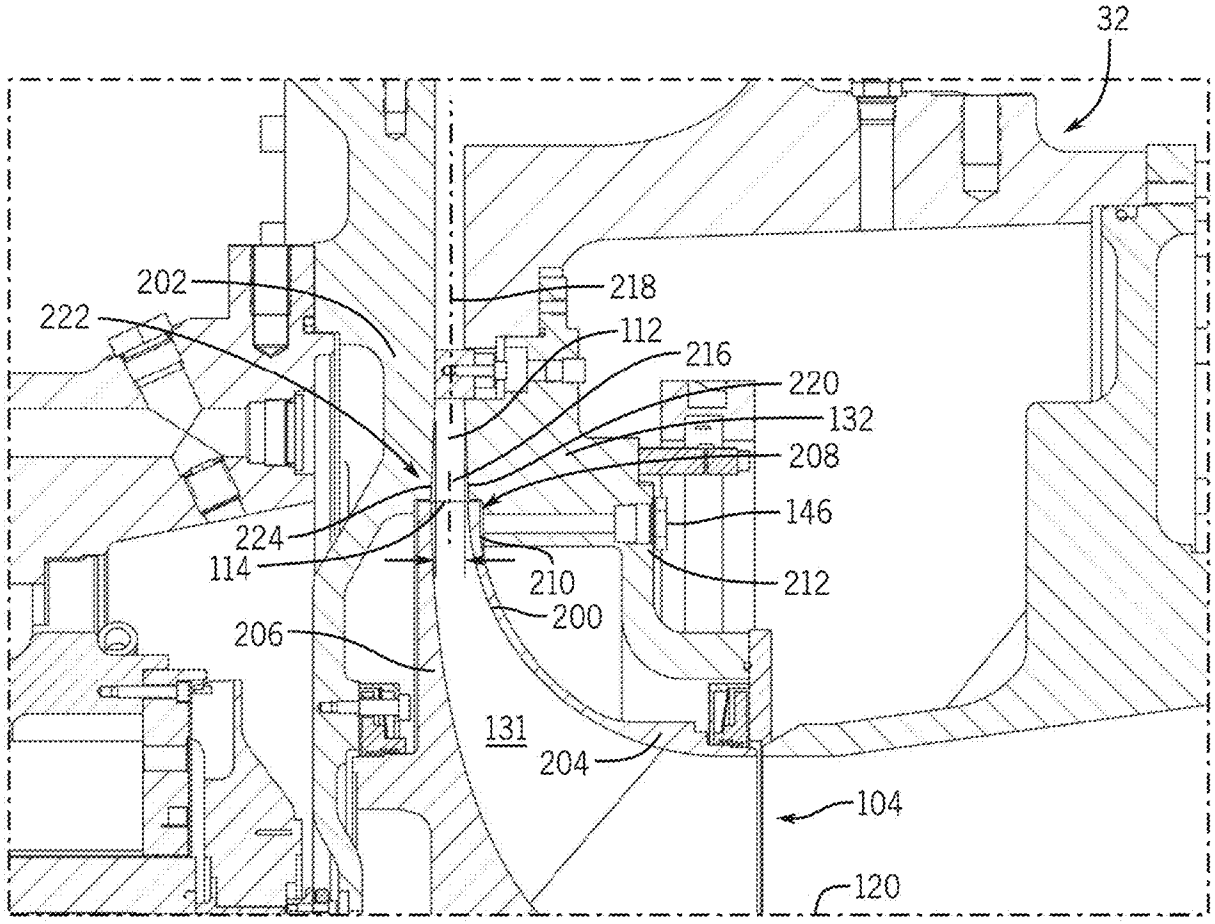
FIG. 6 is a cross-sectional side view of an embodiment of a portion of a compressor of an HVAC&R system, in accordance with an aspect of the present disclosure.

FIG. 6 is a cross-sectional side view of an embodiment of a portion of the compressor 32. The compressor 32 includes similar elements and element numbers as described above. The diffuser passage 112 of the compressor 32 may be defined at least partially by the shroud housing portion 132 of the housing 100 and a hub housing portion 202 of the housing 100. The shroud housing portion 132 may be configured to enclose a portion of the impeller 104. For example, the impeller 104 may include a shroud 204, which may be integral with and/or connected to the blades 131 of the impeller 104. In particular, the shroud 204 may include a blade-facing surface 200 connected to the blades 131 of the impeller 104. Indeed, a position of the shroud 204 may be fixed relative to the position of the blades 131, such that rotation of the blades 131 causes corresponding rotation of the shroud 204 and/or axial movement of the blades 131 (e.g., along the axis 120) causes corresponding axial movement of the shroud 204. The shroud housing portion 132 may enclose or surround at least a portion of the shroud 204 and the blades 131. The hub housing portion 202 may be configured to enclose another portion of the impeller 104. For instance, the impeller 104 may include a hub 206, which may be attached to the shaft 102, and the hub housing portion 202 may enclose or surround at least a portion of the hub 206.

In the illustrated embodiment, the first sensor 146 (e.g., proximity sensor) is coupled to and extends through the shroud housing portion 132. For example, the impeller 104 may be positioned within the housing 100 to establish a gap or space 208 between a surface 210 (e.g., an outer surface, an outer shroud surface, a machined surface, a planar surface) of the shroud 204 and the shroud housing portion 132. A hole 212 (e.g., an opening, a passage) may be formed in the shroud housing portion 132 and may extend to the gap 208, and the first sensor 146 may be inserted through the hole 212 and may be exposed to the gap 208. Accordingly, the first sensor 146 may detect a distance (e.g., axial distance along axis 120) between the surface 210 and the shroud housing portion 132. As an example, the first sensor 146 may include a non-contact sensor, such as an eddy current sensor, a capacitive sensor, an optical sensor, an ultrasonic sensor, an inductive sensor, a Hall effect sensor, and/or another suitable type of sensor. The first sensor 146 may be sealingly positioned within the hole 212, such as via seals positioned within and/or adjacent the hole 212 (e.g., about the first sensor 146). That is, the first sensor 146 and/or seals may block working fluid from flowing through the hole 212 between the first sensor 146 and the shroud housing portion 132, thereby maintaining the flow of working fluid through the impeller 104 and the diffuser passage 112.

To facilitate detection of and/or measurement of the gap 208 (e.g., a magnitude of the gap 208 extending from the shroud housing portion 132 and/or the first sensor 146 to the surface 210) via the first sensor 146, the surface 210 may be planar (e.g., flat) and/or may extend along a circumference of the impeller 104. In this way, a more accurate and/or more representative detection of the distance (e.g., an average distance) between the surface 210 and the shroud housing portion 132 by the first sensor 146 is enabled during rotation of the impeller 104 about the axis 120. That is, the distance measured by the first sensor 146 based on detection of the surface 210 may better (e.g., more accurately, more reliably) indicate the position of the impeller 104 relative to the housing 100 (e.g., the shroud housing portion 132). For example, such a configuration of the surface 210 may reduce detected distance changes caused by a variation of a contour (e.g., a curvature) of the impeller 104 and/or other potential factors that may affect detection and/or measurement of the distance between the surface 210 and the shroud housing portion 132, but are not associated with movement of the impeller 104 relative to the housing 100 (e.g., along the axis 120). As such, the data and/or feedback (e.g., distance data) provided to the control system 134 by the first sensor 146 may enable more suitable and reliable operation of the control system 134 to adjust a position of the impeller 104.

As will be appreciated, it may be desirable to align the impeller exit 114 of the impeller 104 with the diffuser passage 112 to enable more efficient flow of the working fluid through the compressor 32. For instance, it may be desirable to align a first central axis 216 of the impeller exit 114 with a second central axis 218 of the diffuser passage 112. Maintaining alignment between the impeller exit 114 and the diffuser passage 112 may reduce or mitigate pressure and/or flow losses associated with (e.g., imparted to) the flow of the working fluid, such as due to friction (e.g., between the working fluid and the shroud housing portion 132, between the working fluid and the hub housing portion 202) and/or other undesirable (e.g., turbulent) flow of the working fluid. In this way, maintaining alignment the impeller exit 114 and the diffuser passage 112 enables more efficient operation of the compressor 32. However, during operation of the compressor 32, the impeller 104 may shift (e.g., along the axis 120) to cause the impeller exit 114 and the diffuser passage 112 to become misaligned (e.g., misalignment of the first central axis 216 and the second central axis 218).

Therefore, in accordance with present techniques, the control system 134 is configured to monitor, adjust, and/or otherwise control the axial position of the impeller 104 (e.g., along the axis 120) to enable alignment of the impeller exit 114 and the diffuser passage 112. The distance between the surface 210 and the shroud housing portion 132 may be indicative of alignment and/or misalignment between the impeller exit 114 and the diffuser passage 112. The control system 134 may monitor and adjust the axial position of the impeller 104 (e.g., via control of the first bearing 118, thrust bearing) to control, adjust, and/or maintain the distance between the surface 210 and the shroud housing portion 132, such as to maintain the distance to be within a predetermined range of distance values. The predetermined range of distance values may be associated with desirable positioning of the impeller exit 114 relative to the diffuser passage 112 (e.g., correspond to acceptable or desirable alignment of the first central axis 216 and the second central axis 218).

Although the illustrated first sensor 146 is positioned within the shroud housing portion 132, in additional or alternative embodiments, the first sensor 146 may be positioned within the hub housing portion 202. In such embodiments, the first sensor 146 may be configured to detect a distance (e.g., axial distance, along axis 120) between a surface (e.g., axial surface) of the hub 206 and the hub housing portion 202, and the control system 134 may be configured to monitor, adjust, and/or otherwise control the axial position of the impeller 104 (e.g., via control of the first bearing 118) based on the distance between the surface of the hub 206 and the hub housing portion 202 detected by the first sensor 146.

It should be noted that in certain existing systems, the diffuser passage 112 may be shaped (e.g., tapered) to accommodate anticipated misalignment between the impeller exit 114 and the diffuser passage 112 during operation of the compressor 32. For example, the geometry of the diffuser passage 112 may be selected and/or configured to limit or mitigate losses (e.g., pressure losses, flow losses) of the working fluid during misalignment between the impeller exit 114 and the diffuser passage 112. In some embodiments, the shroud housing portion 132 may include a first tapered surface 220 (e.g., a sloped surface) that may extend obliquely relative to the second central axis 218 to provide a diffuser inlet 222 having a larger dimension (e.g., a larger diameter, a larger width, along axis 120) than that of the diffuser passage 112 downstream of the diffuser inlet 222 relative to a working fluid flow through the diffuser passage 112. Additionally or alternatively, the diffuser inlet 222 may have a larger dimension (e.g., a larger diameter, a larger width, along axis 120) than that of the impeller exit 114. In additional or alternative embodiments, the hub housing portion 202 may include a second tapered surface 224 that may extend obliquely relative to the second central axis 218 to provide the diffuser inlet 222 having the relatively larger dimension.

The tapered geometry of the diffuser passage 112 described above may cause relatively increased losses (e.g., as compared to a diffuser passage 112 without such tapered geometry) when the impeller exit 114 and the diffuser passage 112 are aligned with one another (e.g., during alignment of the first central axis 216 and the second central axis 218). Thus, existing systems may be susceptible to reduced operational efficiency of the compressor 32 when the impeller exit 114 and the diffuser passage 112 are aligned. Controlling (e.g., adjusting) the axial position of the impeller 104 to maintain general and/or intended alignment between the impeller exit 114 and the diffuser passage 112 may enable the diffuser passage 112 to be manufactured with reduced shaping (e.g., tapering) that is otherwise intended to accommodate anticipated misalignment of the impeller exit 114 and the diffuser passage 112.

Embodiments of the present disclosure may include the diffuser passage 112 with a non-tapered or generally linear (e.g., along the first central axis 216) geometry. For instance, the shroud housing portion 132 and/or the hub housing portion 202 may have surfaces defining the diffuser passage 112 that radially extend from the impeller exit 114 relative to the axis 120 (e.g., generally parallel to the first central axis 216 and/or the second central axis 218) instead of having the tapered surfaces 220, 224. As an example, the surface of the hub housing portion 202 may extend radially (e.g., completely radially) relative to the axis 120, and the surface of the shroud housing portion 132 may be tapered (e.g., first tapered surface 220). As another example, the surface of the shroud housing portion 132 may extend radially (e.g., completely radially) relative to the axis 120, and the surface of the hub housing portion 202 may be tapered (e.g., second tapered surface 224). The radial extension of the surface(s) of the shroud housing portion 132 and/or of the hub housing portion 202 may enable reduced pressure and/or flow losses of the working fluid when the impeller exit 114 and the diffuser passage 112 are aligned with one another and may therefore increase efficiency in operation of the compressor 32 while the impeller exit 114 and the diffuser passage 112 are aligned. Further, manufacture of the impeller 104 with the diffuser passage 112 having a non-tapered or generally linear geometry may be enable a reduction in costs associated with manufacture of the impeller 104.

Figure 7:
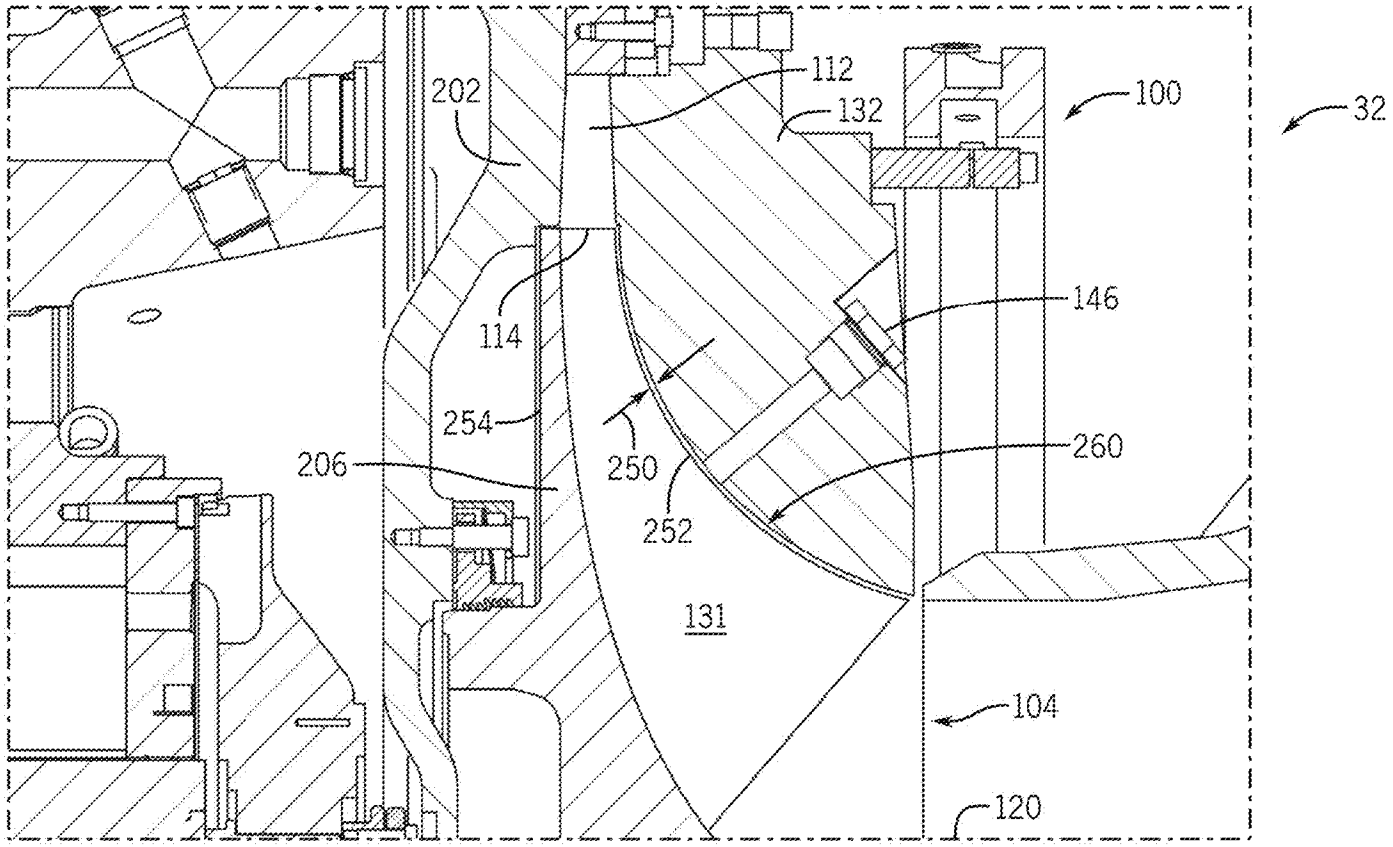
FIG. 7 is a cross-sectional side view of an embodiment of a portion of a compressor of an HVAC&R system, in accordance with an aspect of the present disclosure.

FIG. 7 is a cross-sectional side view of an embodiment of a portion of the compressor 32. The compressor 32 may include certain similar elements and element numbers as described above. As shown, the first sensor 146 is positioned within the shroud housing portion 132. Additionally, in the illustrated embodiment, the impeller 104 of the compressor 32 is shown as an unshrouded or partially unshrouded impeller 104 (e.g., without the shroud 204). Thus, the blades 131 of the impeller 104 are exposed to the shroud housing portion 132. For example, the unshrouded impeller 104 of FIG. 7 may be lighter than a shrouded impeller, such as the impeller 104 of FIG. 6, and may therefore reduce a weight of the compressor 32. The lighter weight of the unshrouded impeller 104 may provide ease of manufacture, installation, transportation, maintenance, and so forth, of the compressor 32. Additionally or alternatively, the lighter, unshrouded impeller 104 may be controlled to rotate at higher speeds as compared to a heavier (e.g., shrouded) impeller. In some embodiments, the unshrouded impeller 104 may be manufactured at reduced costs compared to the impeller 104 of FIG. 6 having the shroud 204.

In an installed configuration of the impeller 104 within the housing 100, a gap or space 250 (e.g., a clearance, clearance region) may extend between blade tips or edges 252 (e.g., distal edges, distal surfaces, blade tip surfaces) of the blades 131 of the impeller 104 and the shroud housing portion 132 (e.g., an inner surface 260 of the shroud housing portion 132 facing the blades 131). The first sensor 146 may extend through the shroud housing portion 132 to be exposed to the gap 250 and/or the blade tips 252. Thus, the first sensor 146 may be configured to detect, measure, and/or monitor a distance between the blade tips 252 (e.g., respective surfaces or edges of the blade tips 252) and the shroud housing portion 132. For instance, during operation of the impeller 104, the blades 131 may bend, flex, deflect, or otherwise deform (e.g., relative to the hub 206). For example, the blades 131 may pivot or deflect outward (e.g., radially outward) relative to the axis 120 and/or relative to the hub 206. Deflection of the blades 131 in this manner may reduce a size or magnitude of the gap 250 (e.g., clearance), which may increase a likelihood of contact between the blades 131 (e.g., blade tips 252) and the shroud housing portion 132. As an example, an increased speed of rotation of the impeller 104 may impart a force onto the blades 131 (e.g., induced by contact between the blades 131 and the working fluid) to bend or deflect the blades 131 and reduce the size of the gap 250 (e.g., reduce the clearance between the blade tips 252 and the shroud housing portion 132). As another example, an increased temperature of the impeller 104 (e.g., caused by friction during operation of the compressor 32, caused by increased operation temperature) may cause thermal expansion of the blades 131 at least partially in a direction toward the shroud housing portion 132, which may reduce the size or dimension of the gap 250. Indeed, increasing the speed of rotation and/or increasing the temperature of the impeller 104 may reduce the size of the gap 250, which thereby reduces an amount of clearance between the blade tips 252 and the shroud housing portion 132.

For this reason, the control system 134 is configured to adjust an axial position of the impeller 104 (e.g., in real-time during operation of the compressor 32) such that the distance between the blade tips 252 and the shroud housing portion 132 is equal to or greater than a predetermined distance, thereby maintaining a desirable amount of clearance (e.g., a desirable magnitude of the gap 250) between the blade tips 252 and the shroud housing portion 132. For example, the control system 134 may dynamically operate the magnetic bearing components 142, 144 of the first bearing 118 to adjust the position of the collar 140, the shaft 102, and the impeller 104 (e.g., along the axis 120) that are coupled to one another relative to the shroud housing portion 132, such as based on data and/or feedback. In some embodiments, the control system 134 may operate the first bearing 118 to adjust the position of the impeller 104 based on sensor data (e.g., sensor from the first sensor 146). The first sensor 146 may detect a magnitude of the distance between the blade tips 252 and the shroud housing portion 132 and provide data or feedback indicative of the magnitude of the distance (e.g., the gap 250) to the control system 134. In response, the control system 134 may adjust operation of the first bearing 118 based on the feedback indicative of the magnitude of the distance.

In some embodiments, the control system 134 may compare the magnitude of the distance detected by the first sensor 146 with a predetermined or threshold distance value (e.g., threshold clearance value) or range of threshold distance values, which may be stored in the memory 136, and adjust the position of the impeller 104 (e.g., via control of the first bearing 118) based on the comparison. In some instances, the threshold distance value may be associated with, correlated with, and/or may correspond to a position of the impeller 104 in which the impeller exit 114 and the diffuser passage 112 are aligned with one another. Thus, the present techniques may enable more efficient operation of the compressor 32 (e.g., more efficient flow of the working fluid, reduced pressure drop, etc.). Additionally or alternatively, the threshold distance value (e.g., stored in the memory 136) may be associated with, correlated with, and/or may correspond to a desired magnitude of the distance between the blade tips 252 and the shroud housing portion 132 In some embodiments, the control system 134 may control the first bearing 118 to maintain the distance between the blade tips 252 and the shroud housing portion 132 within a predetermined range of distance values associated with desirable positioning of the impeller 104 within the housing 100 (e.g., relative to the shroud housing portion 132).

Accordingly, the control system 134 may control the first bearing 118, and thereby control and/or adjust the position of the impeller 104, to block potential contact between the blade tips 252 and the shroud housing portion 132. In this way, the present techniques enable maintenance of a structural integrity of the blade tips 252 and the shroud housing portion 132. The present techniques also enable implementation and/or operation of the unshrouded impeller 104, such as at different speeds of rotation of the impeller 104 and/or different operating temperatures associated with the compressor 32.

In the illustrated embodiment, the shroud housing portion 132 extends along a profile of the impeller 104, such as along the blade tips 252 and/or along a profile defined by the blade tips 252. As such, the first sensor 146 may be disposed at any suitable position or orientation within the shroud housing portion 132 to extend toward the gap 250, such as at any suitable angle relative to the axis 120. Additionally or alternatively, the first sensor 146 may be positioned in (e.g., extend within) the hub housing portion 202 and may be configured to monitor a distance between a surface 254 of the hub 206 and the hub housing portion 202 (e.g., along the axis 120). Therefore, the control system 134 may be configured to control the axial position of the impeller 104 based on the distance between the surface 254 of the hub 206 and the hub housing portion 202 in a manner similar to that described above.

Figure 8:
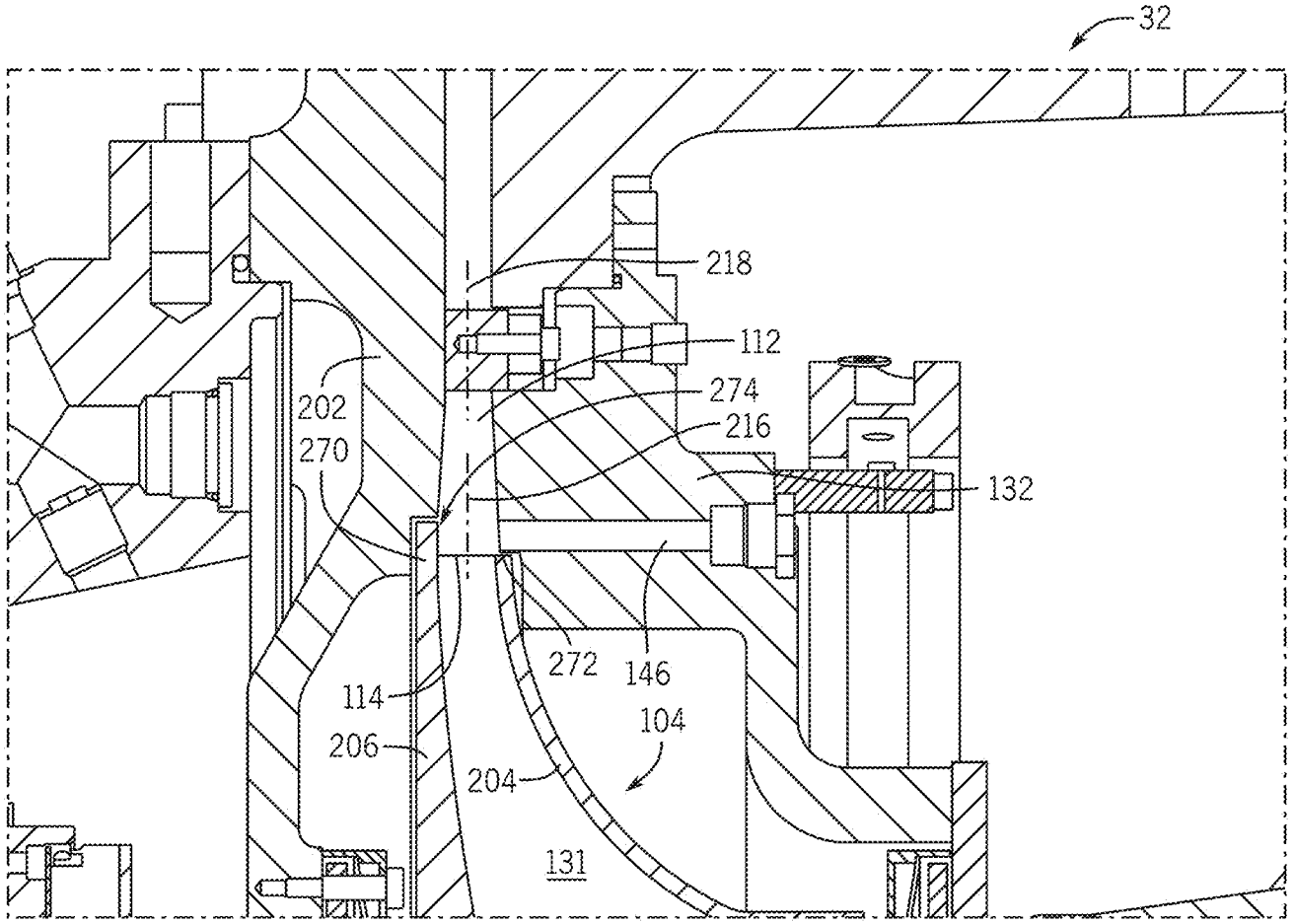
FIG. 8 is a cross-sectional side view of an embodiment of a portion of a compressor of an HVAC&R system, in accordance with an aspect of the present disclosure

FIG. 8 is a cross-sectional side view of an embodiment of a portion of the compressor 32. In the illustrated embodiment, the first sensor 146 is positioned within the shroud housing portion 132. The impeller 104 also includes the shroud 204. Additionally, the hub 206 of the impeller 104 includes a wall 270 that extends downstream of the impeller exit 114 relative to a flow of working fluid through the impeller exit 114. In other words, the impeller exit 114 may be generally defined as a port or outlet of the impeller 104 extending from a radially outer edge 272 (e.g., distal end) of the shroud 204 to the wall 270 (e.g., along the axis 120), and the wall 270 may extend downstream of the impeller exit 114 (e.g., towards and/or along the diffuser passage 112).

As shown, the first sensor 146 extends through the shroud housing portion 132 and is exposed to the diffuser passage 112. In other words, the first sensor 146 extends through the shroud housing portion 132 and is positioned downstream of the impeller exit 114 and/or the radially outer edge 272 of the shroud 204 (e.g., relative to a flow of working fluid through the impeller 104). Thus, the first sensor 146 may be positioned to detect the wall 270 of the hub 206 (e.g., along the axis 120). That is, the wall 270 may be exposed to, and may be detected by, the first sensor 146. For example, the first sensor 146 may detect a distance between a surface 274 of the wall 270 and the shroud housing portion 132. The surface 274 may also be exposed to working fluid flow. As similarly described above, the distance between the surface 274 of the wall 270 and the shroud housing portion 132 may be indicative of a position of the impeller 104 relative to the housing 100, such as an alignment between the impeller exit 114 and the diffuser passage 112 and/or a distance between the impeller 104 (e.g., the blade tips 252, the shroud 204) and the shroud housing portion 132. In a manner similar to that described above, the control system 134 may control an axial position of the impeller 104 (e.g., via control of the first bearing 118, along the axis 120) to control, adjust, and/or maintain the distance between the wall 270 and the shroud housing portion 132 (e.g., a distance between the shroud 204 or the blade tips 252 and the shroud housing portion 132). For example, the control system 134 may adjust the position of the impeller 104 such that a distance from the wall 270 (e.g., the surface 274) to the shroud housing portion 132 (e.g., the first sensor 146) is within a predetermined range of distance values associated with desirable positioning of the impeller 104 relative to the housing 100 (e.g., alignment of the impeller exit 114 relative to the diffuser passage 112, alignment of the first central axis 216 and the second central axis 218).

In additional or alternative embodiments, the first sensor 146 may be configured to detect a different surface of the impeller 104, such as another surface exposed to working fluid flow directed through the impeller 104. For example, the shroud 204 may include a wall that extends downstream of the impeller exit 114 relative to a flow of working fluid through the diffuser passage 112 (e.g., similar to wall 270), and the first sensor 146 may be positioned within and extend through the hub housing portion 202. In such an embodiment, the first sensor 146 may be configured to detect a distance between a surface of the wall of the shroud 204 and the hub housing portion 202. In such embodiments, the control system 134 may be configured to control the axial position of the impeller 104 (e.g., via control of the first bearing 118) based on the distance between the wall of the shroud 204 and the hub housing portion 202, such as to achieve a desired alignment of the impeller exit 114 and the diffuser passage 112.

Figure 9:
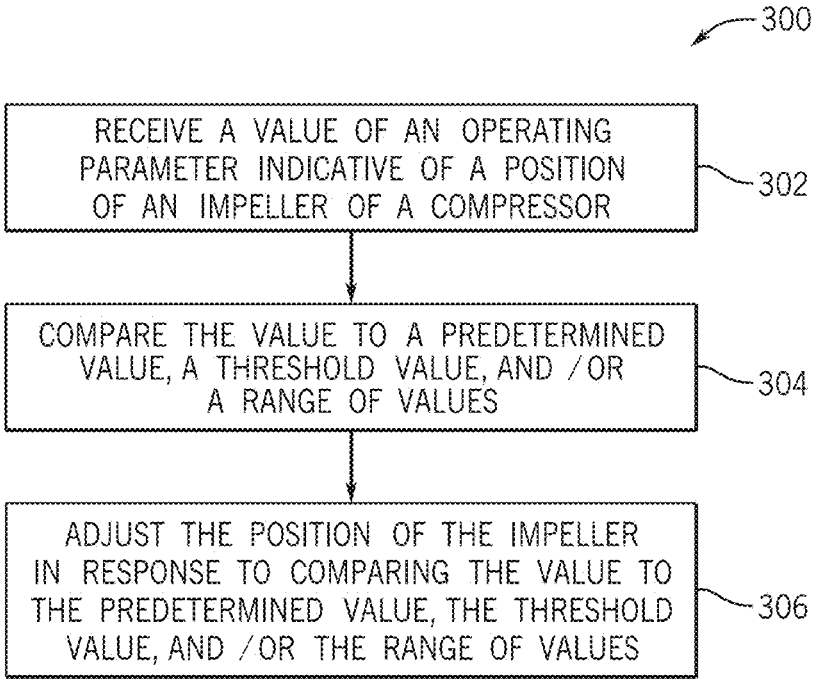
FIG. 9 is a flowchart of an embodiment of a method for operating a compressor of an HVAC&R system, in accordance with an aspect of the present disclosure.

FIG. 9 is a flowchart of an embodiment of a method 300 for adjusting a position of the impeller 104. In some embodiments, the method 300 may be performed by a single respective component or system, such as by the control system 134 (e.g., the processing circuitry 138). In additional or alternative embodiments, multiple components or systems may perform the steps of the method 300. It should also be noted that additional steps may be performed with respect to the method 300. Moreover, certain steps of the depicted method 300 may be removed, modified, and/or performed in a different order than that shown in FIG. 9.

At block 302, a value of an operating parameter indicative of a position of the impeller 104 may be received. For example, the value of the operating parameter (e.g., data indicative of the value) may be detected by the first sensor 146 and may be received by the control system 134 from the first sensor 146. In some embodiments, the operating parameter may include a distance from the surface 210 of the shroud 204 to the housing 100 (e.g., the shroud housing portion 132, the inner surface 260 of the shroud housing portion 132). In additional or alternative embodiments, the operating parameter may include a distance from the blade tips 252 to the housing 100 (e.g., the shroud housing portion 132, the inner surface 260 of the shroud housing portion 132), a distance from the surface 254 of the hub 206 to the housing 100 (e.g., the hub housing portion 202), a distance from the wall 270 of the impeller 104 and the housing 100 (e.g., the shroud housing portion 132), and/or a distance from any other portion of the impeller 104 to the housing 100. Indeed, the operating parameter may be indicative of a magnitude or dimension of the gap 250 (e.g., clearance) between the impeller 104 and the housing 100. The operating parameter may also be indicative of an alignment of the impeller exit 114 relative to the diffuser passage 112.

At block 304, the value of the operating parameter may be compared (e.g., by the control system 134) with a predetermined value, a threshold value, and/or a range of values, which may be stored in the memory 136. The predetermined value, the threshold value, and/or the range of values may correspond to a desirable position of the impeller 104. For example, the desirable position may correspond to a desired alignment between the impeller exit 114 and the diffuser passage 112 (e.g., alignment of the first central axis 216 and the second central axis 218). In some instances, the range of values may include an upper threshold value and a lower threshold value (e.g., a predetermined value) that define or correspond to a range of positions of the impeller 104 that provide acceptable alignment of the impeller exit 114 and the diffuser passage 112. Additionally or alternatively, the desirable position may correspond to a desired distance (e.g., clearance) between the impeller 104 (e.g., the shroud 204, the blade tips 252) and the shroud housing portion 132 (e.g., the inner surface 260).

In some embodiments, the predetermined value, the threshold value, and/or the range of values may be selected from multiple predetermined values, threshold values, and/or ranges of values stored in the memory 136. The selection of a particular predetermined value, threshold value, and/or range of values (e.g., by the control system 134) may be based on another operating parameter of the compressor 32 existing or detected at the time of the comparison, such as a dimension (e.g., a diameter, a size of the impeller exit 114) associated with the impeller 104, an operating capacity of the compressor 32, a rotational speed of the impeller 104, a temperature and/or pressure (e.g., suction temperature and/or pressure) of the working fluid, a type of the working fluid, a temperature of the shaft 102, another suitable operating parameter, and/or any combination thereof. In some applications, one or more of the predetermined values, the threshold values, and/or the ranges of values may be a calibrated value corresponding to a desired position of the impeller 104, as described herein.

At block 306, the position of the impeller 104 within the housing 100 may be adjusted (e.g., via the control system 134) in response to a comparison of the value (e.g., detected by the first sensor 146) with the predetermined value, the threshold value, and/or the range of values. By way of example, a current transmitted to the magnetic bearing components 142, 144 may be adjusted by the control system 134 to adjust a magnetic force imparted on the collar 140 in order to adjust an axial position of the collar 140 (e.g., along the axis 120) and cause the axial position of the shaft 102 and the impeller 104 to be adjusted accordingly. For instance, the axial position of the impeller 104 may be adjusted to maintain the value of the operating parameter (e.g., detected by the first sensor 146) within the range of values and/or to adjust the value of the operating parameter to be within the range of values. Similarly, the axial position of the impeller 104 may be adjusted to maintain the value of the operating parameter (e.g., detected by the first sensor 146) at approximately equal to a predetermined or threshold value and/or to adjust the value of the operating parameter to approach and approximately equal the predetermined or threshold value. Indeed, the method 300 described herein may be implemented to achieve a particular (e.g., desired, minimum, smallest allowable) distance or magnitude of the gap 250 (e.g., clearance) between the impeller 104 and the housing 100. In this way, the method 300 enables more efficient operation of the compressor 32 (e.g., reduced losses, improved performance) and/or more desirable positioning between the impeller 104 and the shroud housing portion 132 at variable operating conditions of the compressor 32.

It should be noted that the method 300 may be repeatedly (e.g., continually) performed during operation of the compressor 32. For example, the value of the operating parameter may be received from the first sensor 146 and by the control system 134 at a desired frequency (e.g., several kilohertz) or interval for comparison with a predetermined value, threshold value, and/or a range of values. As a result of the comparison(s), the position of the impeller 104 may be adjusted or maintained accordingly utilizing the presently disclosed techniques. The techniques described herein may also be utilized to resolve and/or compensate for other variable parameters of the compressor 32, such as variable working fluid conditions, manufacturing tolerances, and so forth. Further, in some instances, the method 300 may be utilized to evaluate performance of the compressor 32 (e.g., in real time) at various operating conditions and/or with the impeller 104 positioned at different positions within the housing 100. For example, the control system 134 may adjust the position of the impeller 104 relative to the shroud housing portion 132, and the control system 134 may receive feedback from other sensors of the HVAC&R system 10 indicative of the performance of the compressor 32 and/or HVAC&R system 10 for assessment of changes in performance caused by positional change of the impeller 104.

The present disclosure may provide one or more technical effects useful in the operation of an HVAC&R system. For example, the HVAC&R system may include a compressor with an impeller disposed within a housing. The impeller may rotate to pressurize working fluid flow and direct the working fluid flow through the impeller to a diffuser passage. During operation of the compressor, a relative positioning between the impeller and the housing may be adjusted. For example, a geometry and/or position of the impeller may change as a result of thermal growth of a shaft to which the impeller is connected. As another example, a geometry of the impeller, such as blades of an unshrouded impeller, may vary at different rotational speeds of the impeller. Therefore, a distance between a surface of the impeller (e.g., a surface of a shroud of the impeller, a tip of a blade of the impeller, a surface of a wall of the impeller) and the housing may be detected and monitored. A control system may receive data indicative of the detected distance and may compare the detected distance to a particular value or range of values associated with a desirable position of the impeller. In response to the comparison, the control system may adjust the position of the impeller such that the detected distance approaches and/or is approximately equal to a predetermined value and/or is within a range of predetermined values. In particular, the impeller may be coupled to a shaft, and a position of the shaft may be adjusted (e.g., via control of a thrust bearing) to adjust the desired position of the impeller relative to the housing. Adjustment of the position of the impeller may enable desirable alignment between an exit of the impeller and an opening of a diffuser passage and/or provide a desirable clearance between the impeller and the housing. Thus, more efficient operation of the compressor may be achieved. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, air conditioning, and refrigeration (HVAC&R) system, comprising:

a compressor, comprising:

a housing;

a shaft disposed within and extending through the housing; and an impeller coupled to the shaft, wherein the shaft is configured to rotate relative to the housing and about an axis to rotate the impeller; and a controller configured to:

receive data indicative of a distance from a flat surface of a shroud of the impeller to the housing, wherein the flat surface extends along a circumference of the impeller; and adjust a position of the shaft along the axis based on a comparison of the distance from the flat surface of the shroud of the impeller to the housing with a predetermined value, wherein a sensor is directed at the flat surface.

2. The HVAC&R system of claim 1, comprising a thrust bearing coupled to the shaft, wherein the controller is configured to adjust operation of the thrust bearing to adjust the position of the shaft along the axis.

3. The HVAC&R system of claim 2, wherein the thrust bearing is positioned at a first end of the shaft, and the impeller is coupled to a second end, opposite the first end, of the shaft.

4. The HVAC&R system of claim 3, wherein the thrust bearing is a magnetic thrust bearing, and the controller is configured to adjust a current supplied to the magnetic thrust bearing to adjust the position of the shaft.

5. The HVAC&R system of claim 1, comprising the sensor, wherein the sensor is communicatively coupled to the controller, wherein the sensor is configured to detect the distance from the flat surface of the shroud to the housing and transmit the data indicative of the distance to the controller, and the controller is configured to compare the distance to the predetermined value.

6. The HVAC&R system of claim 5, wherein the sensor extends through a shroud housing portion of the housing.

7. The HVAC&R system of claim 1, wherein the predetermined value corresponds to alignment of an exit of the impeller with a diffuser passage of the housing downstream of the exit with respect to a flow of working fluid through the compressor.

8. The HVAC&R system of claim 7, wherein the diffuser passage of the housing comprises one or more sloped surfaces extending obliquely relative to a central axis of the diffuser passage.

9. The HVAC&R system of claim 1, wherein the predetermined value corresponds to a clearance between the impeller and a shroud housing portion of the housing.

10. The HVAC&R system of claim 1, wherein the controller comprises a memory, and the predetermined value is stored on the memory.

11. A heating, ventilation, air conditioning, and refrigeration (HVAC&R) system, comprising:

a controller configured to:

receive, from a sensor disposed within a compressor, data indicative of a distance from a circumferential surface of a shroud of an impeller to a housing of the compressor, wherein the circumferential surface of the shroud is a flat surface;

compare the distance to a predetermined value; and adjust a position of a shaft coupled to the impeller along a rotational axis of the shaft based on comparison of the distance from the flat surface of the shroud of the impeller to the housing with the predetermined value to adjust a position of the impeller relative to the housing, wherein the sensor is directed at the flat surface.

12. The HVAC&R system of claim 11, wherein the predetermined value corresponds to alignment of a first central axis of an exit of the impeller with a second central axis of a diffuser passage of the housing downstream of the exit with respect to a flow of working fluid through the compressor.

13. The HVAC&R system of claim 11, wherein the controller is configured to adjust operation of a magnetic thrust bearing coupled to the shaft to adjust the position of the shaft.

14. The HVAC&R system of claim 11, wherein the controller is configured to:

compare the distance to a range of values, wherein the range of values comprises the predetermined value; and adjust the position of the shaft based on comparison of the distance from the flat surface of the shroud of the impeller to the housing with the range of values to adjust the position of the impeller relative to the housing.

15. The HVAC&R system of claim 11, comprising the sensor, wherein the sensor is configured to extend through a shroud housing portion of the housing in an axial direction, and the flat surface of the shroud extends crosswise to the axial direction.

16. A heating, ventilation, air conditioning, and refrigeration (HVAC&R) system, comprising:

a compressor, comprising:

a housing;

a shaft disposed within and extending through the housing;

a thrust bearing disposed within the housing and coupled to the shaft; and an impeller disposed within the housing and coupled to the shaft, wherein the impeller comprises a plurality of blades and a shroud fixed to the plurality of blades, and the shroud comprises a flat surface extending about a circumference of the impeller; and a controller configured to control operation of the thrust bearing based on data indicative of a detected distance from the housing to the flat surface of the shroud of the impeller, wherein a sensor is directed at the flat surface.

17. The HVAC&R system of claim 16, wherein the thrust bearing is positioned at a first end of the shaft, and the impeller is coupled to a second end, opposite the first end, of the shaft.

18. The HVAC&R system of claim 16, comprising the sensor, wherein the sensor is disposed within the compressor, wherein the sensor is communicatively coupled to the controller, and the sensor is configured to transmit the data indicative of the detected distance to the controller, and wherein the controller is configured to:

compare the detected distance to a predetermined value; and control operation of the thrust bearing based on comparison of the detected distance to the predetermined value.

19. The HVAC&R system of claim 18, wherein the predetermined value corresponds to alignment of an exit of the impeller with a diffuser passage of the housing downstream of the exit with respect to a flow of working fluid through the compressor.

20. The HVAC&R system of claim 16, comprising the sensor, wherein the sensor is disposed within the compressor, wherein the sensor is communicatively coupled to the controller, and the sensor is configured to detect the flat surface to measure the detected distance.

* * * * *